US008449351B2

(12) United States Patent
Moon et al.

(10) Patent No.: US 8,449,351 B2
(45) Date of Patent: May 28, 2013

(54) LOWER UNIT FOR GLASS POLISHING SYSTEM AND GLASS POLISHING METHOD USING THE SAME

(75) Inventors: Won-Jae Moon, Seoul (KR); Sang-Oeb Na, Seoul (KR); Hyung-Young Oh, Goyang-si (KR); Yang-Han Kim, Goyang-si (KR); Young-Sik Kim, Seoul (KR); Kil-Ho Kim, Suwon-si (KR); Heui-Joon Park, Incheon (KR); Chang-Hee Lee, Osan-si (KR); Dae-Yeon Lee, Chungbuk (KR); Jae-Ik Song, Cheongju-si (KR); Wook Jeong, Cheongju-si (KR); Young-Kuk Kim, Chungbuk (KR); Kyu-Chul Chung, Chungbuk (KR); Hyun-Chul Chung, Cheongju-si (KR)

(73) Assignee: LG Chem, Ltd., Seoul (KR)

( * ) Notice: Subject to any disclaimer, the term of this patent is extended or adjusted under 35 U.S.C. 154(b) by 505 days.

(21) Appl. No.: 12/718,772

(22) Filed: Mar. 5, 2010

(65) Prior Publication Data

US 2010/0227534 A1 Sep. 9, 2010

(30) Foreign Application Priority Data

Mar. 6, 2009 (KR) ..... 10-2009-0019290
Mar. 6, 2009 (KR) ..... 10-2009-0019292
Mar. 6, 2009 (KR) ..... 10-2009-0019293
Jan. 26, 2010 (KR) ..... 10-2010-0007100

(51) Int. Cl.
*B24B 1/00* (2006.01)

(52) U.S. Cl.
USPC ..... 451/41; 451/390; 451/325; 451/396; 269/289 R

(58) Field of Classification Search
USPC 451/41, 285–289, 390, 398, 325; 269/289 R, 269/900, 903
See application file for complete search history.

(56) References Cited

U.S. PATENT DOCUMENTS 3,488,174 A * 1/1970 Boudet ..... 65/61
3,828,483 A * 8/1974 Blum et al. ..... 451/276
4,221,083 A * 9/1980 Carroll ..... 451/42
4,530,139 A * 7/1985 Miller ..... 29/25.35
4,850,152 A * 7/1989 Heynacher et al. ..... 451/5
5,816,895 A * 10/1998 Honda ..... 451/41
5,871,393 A * 2/1999 Shiozawa ..... 451/285
5,964,652 A * 10/1999 Melzner et al. ..... 451/285
6,106,369 A * 8/2000 Konishi et al. ..... 451/41
6,116,987 A * 9/2000 Kubo ..... 451/41
6,126,520 A * 10/2000 Jochim-Schmidt et al. .... 451/42
6,126,528 A * 10/2000 Sedlock ..... 451/390
6,135,858 A * 10/2000 Takahashi ..... 451/41
6,162,112 A * 12/2000 Miyazaki et al. ..... 451/36
6,227,956 B1 * 5/2001 Halley ..... 451/288
6,390,901 B1 * 5/2002 Hiyama et al. ..... 451/285
7,081,038 B2 * 7/2006 Ina ..... 451/5
2004/0072515 A1 * 4/2004 Miyahara et al. ..... 451/285

* cited by examiner

*Primary Examiner* — George Nguyen
(74) *Attorney, Agent, or Firm* — McKenna Long & Aldridge, LLP

(57) ABSTRACT

A lower unit for a glass polishing system includes a support installed to a rotatable turntable, and a carrier having a supporting part for supporting a glass to be polished, and a placing part formed in a surface opposite to the supporting part and fixed and placed to the support.

11 Claims, 2 Drawing Sheets

LOWER UNIT FOR GLASS POLISHING SYSTEM AND GLASS POLISHING METHOD USING THE SAME

BACKGROUND OF THE INVENTION

1. Cross-Reference to Related Application

This application claims priority under 35 USC 119(a) to Korean Patent Application Nos. 10-2009-0019290, 10-2009-0019292 and 10-2009-0019293 filed in Republic of Korea on Mar. 6, 2009 and Korean Patent Application No. 10-2010-0007100 filed in Republic of Korea on Jan. 26, 2010, the entire contents of which are incorporated herein by reference.

2. Field of the Invention

The present invention relates to a lower unit for a glass polishing system and a glass polishing method using the same, and more particularly to a lower unit for a glass polishing system, which polishes one surface of a glass used for a liquid crystal display, and a glass polishing method using the same.

3. Description of the Related Art

Generally, it is very important that a glass (or, a glass pane) applied to a liquid crystal display keeps its flatness to a certain level so as to accurately realize images. Thus, fine waviness on a surface of a float glass formed through a float chamber should be removed.

Such a glass polishing process may be classified into so-called 'Oscar' type polishing in which glasses are individually polished one by one, and so-called 'inline' type polishing in which a series of glasses are successively polished.

When a conventional glass polishing device is used, a polishing plate (or, an upper plate) having a polishing pad installed thereto is moved in a horizontal direction, and a polishing stage (or, a lower plate) on which a glass is placed is rotated, during which a polishing slurry is supplied onto the polishing plate by means of free falling to polish the glass.

Meanwhile, in another kind of conventional glass polishing device, a polishing pad is installed to a lower unit, and a glass is fixed to a polishing plate (or, an upper plate). In this state, a predetermined polishing slurry is supplied to the glass so as to polish the glass.

However, in such conventional glass polishing devices and methods, the glass may be unnecessarily scratched due to the carelessness while the glass is carried and mounted to the upper plate or the lower plate of the polishing device. In addition, while the glass is carried to a next process after the polishing work is completed, the glass may be easily damaged.

SUMMARY OF THE INVENTION

The present invention is designed to solve the problems of the prior art, and therefore it is an object of the present invention to provide a lower unit for a glass polishing system, which is improved to minimize scratches occurring on a glass during a polishing process by carrying a carrier supporting the glass by means of a conveyor instead of directly carrying glasses to be polished, polishing the glass using an upper plate in a state that the carrier having a glass loaded thereon is fixed to the lower unit, and separating the carrier supporting the glass from the lower unit and then carrying the carrier to a next process by means of a conveyor if the polishing work is completed.

The present invention is also directed to providing a glass polishing method using the above lower unit.

In order to accomplish the above object, the present invention provides a lower unit for a glass polishing system, which includes a support installed to a rotatable turntable; and a carrier having a supporting part for supporting a glass to be polished, and a placing part formed in a surface opposite to the supporting part and fixed and placed to the support.

Preferably, the lower unit further includes an adhesion sheet interposed between the support and the carrier.

Preferably, the lower unit further includes a mounting pad installed on the supporting part such that the glass to be polished is mounted thereon.

Preferably, the placing part of the carrier further includes a protrusion protruded on a rim of the carrier to surround a side of the support.

Preferably, the carrier is made of any one material selected from the group consisting of stainless steel, aluminum, polycarbonate (PC), polypropylene (PP) and polyethylene (PE).

Preferably, the carrier has a thickness ranging from about 1.0 millimeter to about 20.0 millimeters.

Preferably, in case the carrier is made of stainless steel, the carrier has a thickness of about 1.0 millimeter to about 2.0 millimeters.

Preferably, in case the carrier is made of polycarbonate, the carrier has a thickness of about 4.0 millimeters to about 10.0 millimeters.

Preferably, the support is made of any one material selected from the group consisting of stainless steel, aluminum, carbon steel, tin, granite, polymer concrete and high-strength concrete.

Preferably, the support has a thickness ranging from about 50 millimeters to about 500 millimeters.

In another aspect of the present invention, there is also provided a glass polishing method, which includes (a) placing a carrier having a glass to be polished thereon to a support installed to a turntable; (b) contacting an upper unit having a polishing pad installed thereto to the glass; (c) supplying a polishing slurry to the glass to be polished through the upper unit; and (d) moving the upper unit and the turntable with respect to each other.

Preferably, the glass polishing method further includes separating the carrier from the support, in case the glass is completely polished.

Preferably, in the step (a), the glass to be polished is supported on a mounting pad in a state that the mounting pad is interposed on the carrier.

Preferably, in the step (a), an adhesion sheet is interposed on the support to place the carrier thereto.

Preferably, in the step (a), the support is inserted into a space formed between protrusions formed on a rim of the carrier and formed in a lower surface of the carrier to fix the carrier.

The lower unit for a glass polishing system and the glass polishing method using the same according to the present invention allow minimizing the occurrence of scratch on a glass during a polishing process since the glass to be polished is carried to a polishing device by means of a carrier, the glass is polished in a state that the carrier is fixed to the lower unit while the glass to be polished is mounted to the carrier, and the carrier having the glass mounted thereto is carried to a next process after the polishing work is completed.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Hereinafter, preferred embodiments of the present invention will be described in detail with reference to the accompanying drawings.

Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

Figure 1:
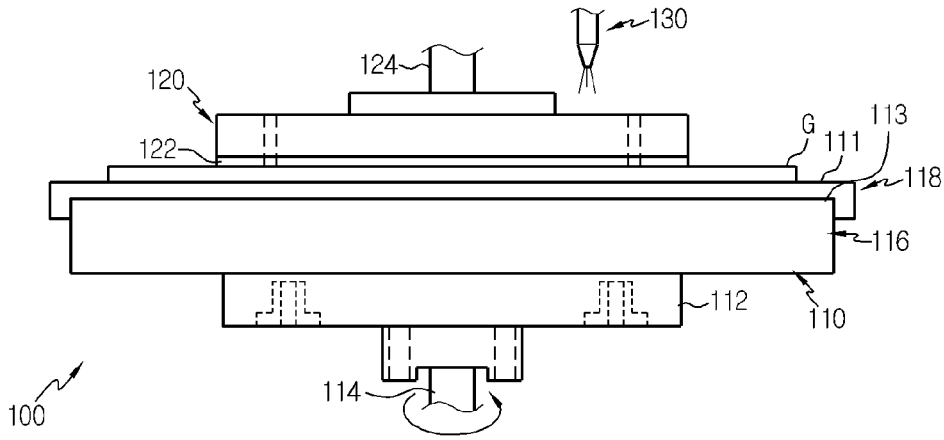
FIG. 1 is a schematic view showing a glass polishing system according to a preferred embodiment of the present invention.

FIG. 1 is a schematic view showing a glass polishing system according to a preferred embodiment of the present invention.

Referring to FIG. 1, a glass polishing system 100 of this embodiment is used for polishing one surface of a large glass G with a length of 1,000 mm or above and a thickness of about 0.3 mm to 1.1 mm to have a flatness necessary for a liquid crystal display, as an example. Also, the glass polishing system 100 includes a lower unit 110 having a turntable 112 capable of rotating the glass G at a predetermined rate in a state that the glass G to be polished is fixed to a certain location, a horizontally and vertically movable upper unit 120 installed above the lower unit 110 and having a polishing pad 122 attached thereto such that the polishing pad 122 may be contacted with an upper surface (or, a surface to be polished) of the glass G held at the lower unit 10, and a polishing slurry supply unit 130 for receiving a polishing slurry from a polishing slurry supply part (not shown) and supplying the polishing slurry to a surface of the glass G through the upper unit 120, as an example.

In the glass polishing system 100 of this embodiment, a dimension (a smaller one between length and width) of a rectangular glass G to be polished is greater than dimensions (or, a diameter in case of a disk shape) of the upper unit 120 and/or the polishing pad 122 attached thereto. In addition, a rotary shaft 114 of the lower unit 110 is not located in a straight line with a spindle 124 of the upper unit 120 but offset and relatively movable with respect to each other, preferably. In the glass polishing system 100 of this embodiment, if the lower unit 110 is rotated and at the same time the upper unit 120 is moved in a horizontal direction along a predetermined trajectory while the polishing pad 122 is contacted with the surface of the glass G to be polished, the entire surface of the glass G is uniformly polished by means of a polishing slurry supplied from the polishing slurry supply unit 130 while the upper unit 120 is passively rotated due to the rotation of the lower unit 110.

In another embodiment, it would be well understood by those having ordinary skill in the art that the upper unit 120 and the polishing slurry supply unit 130 may adopt an upper unit and a polishing slurry supply unit of 'a glass polishing system' disclosed in Korean Patent Application Nos. 10-2009-192290, 10-2009-192292 and 10-2009-192293, filed on Mar. 6, 2009, by the applicant and a dual head type upper unit of 'a glass polishing system' disclosed in Korean Patent Application No. 10-2009-0095706, filed on Oct. 8, 2009, by the applicant. Also, it should be understood that rotation and relative rotation of the upper unit 120 and moving trajectory in a horizontal direction of the upper unit 120 may be adjusted or controlled suitably in accordance with a size of a glass to be polished or the degree of polishing of the glass.

The lower unit 110 for a glass polishing system according to this embodiment includes a support 116 fixed to a turntable 112 capable of being rotated by means of a rotary shaft 114 connected to a drive source (not shown), and a carrier 118 having an upper surface on which the glass G may be supported and a lower surface that may be placed on the support 116.

The carrier 118 includes a supporting part 111 at its upper surface to support a glass G to be polished and a placing part 113 at its lower surface opposite to the supporting part 111. The carrier 118 may be loaded to the glass polishing system 100 by means of a conveyor (not shown) in a state of supporting the glass G by the supporting part 111. The glass G supported by the supporting part 111 of the carrier 118 is placed on the support 116 together with the carrier 118 by means of a separate jig or the like. The placing part may have a separate means for fixing the carrier 118 with respect to the support 116.

Figure 2:
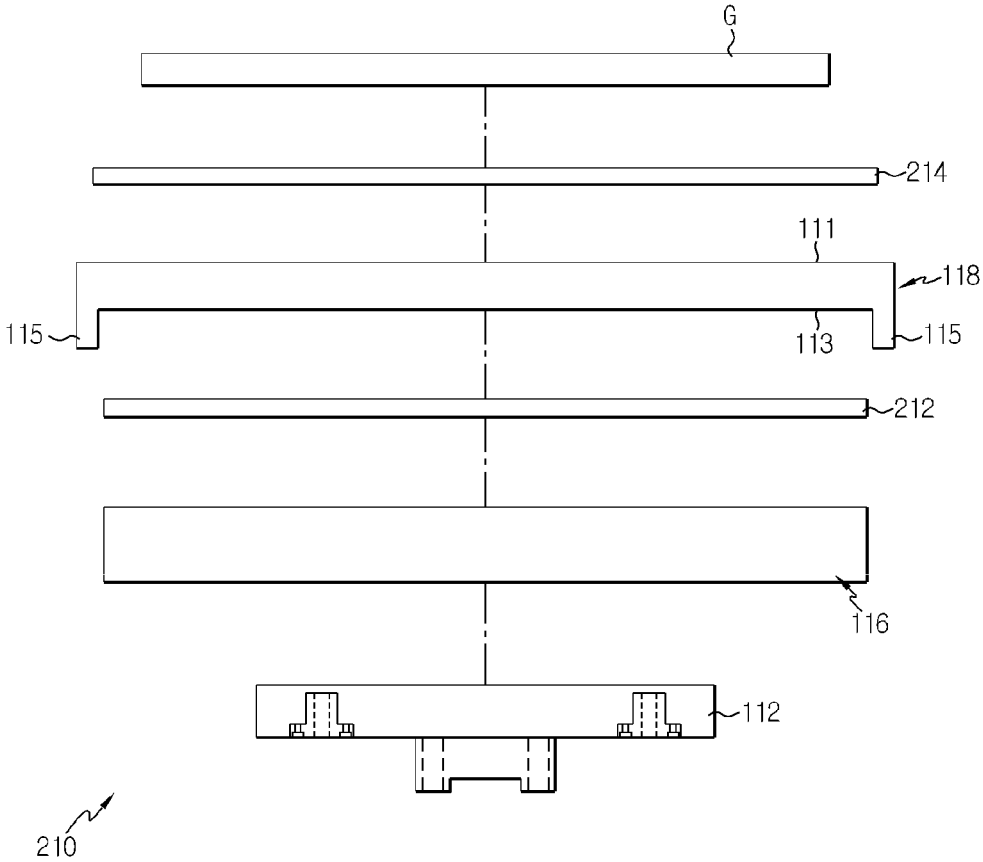
FIG. 2 is an exploded view schematically showing components of a lower unit for the glass polishing system according to another embodiment of the present invention.
Figure 3:
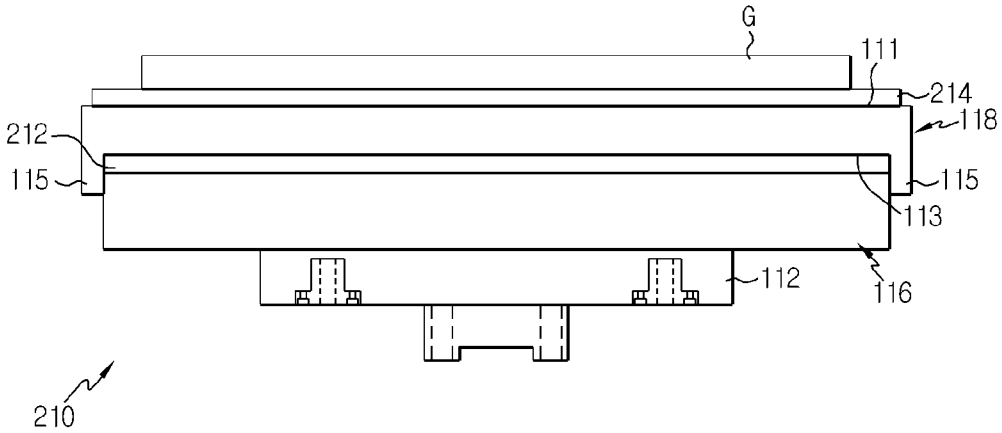
FIG. 3 is an assembled view of FIG. 2.

FIG. 2 is an exploded view schematically showing components of the lower unit for a glass polishing system according to another embodiment of the present invention, and FIG. 3 is an assembled view of FIG. 2. The same reference symbols as used in FIG. 1 indicate the same components with the same functions.

Referring to FIGS. 2 and 3, a lower unit 210 of this embodiment includes a support 116 keeping a high flatness, an adhesion sheet 212 installed to an upper surface of the support 116, a carrier 118 capable of being placed to surround a rim of the support 116 so as to be selectively contacted with an upper surface of the adhesion sheet 212, and a mounting pad 214 interposed between the supporting part 111 of the carrier 118 and the glass G.

The support 116 substantially has a rectangular plate structure, and the support 116 is preferably made of material that is not deformed in spite of long-term use. For this purpose, the support 116 may be made of, for example, stainless steel, aluminum, carbon steel, tin, granite, polymer concrete, high-strength concrete or their mixtures, but not limitedly. The support 116 has a thickness of about 50 millimeters to about 500 millimeters.

The carrier 118 includes the supporting part 111, the placing part 113 and the protrusion 115, as explained above. In other words, the carrier 118 substantially has a rectangular plate structure, and the placing part 113 placed on the support 116 gives a space in which the support 116 may be inserted. If the carrier 118 is mounted to the support 116 such that the placing part 113 and/or the protrusion 115 surround a part of the support 116, the location of the carrier 118 may be fixed with respect to the support 116.

The protrusion 115 formed on the placing part 113 of the carrier 118 is preferably protruded from a rectangular rim of the placing part 113 toward the support 116 as much as about ½ of the height of the support 116. Also, a protruding length of the protrusion 115 may be suitably selected if the protrusion 115 may surround a side of the support 116. The protrusion 115 prevents the carrier 118 from moving in a horizontal direction with respect to the support 116 during the polishing work.

The carrier 118 may be made of stainless steel, aluminum polycarbonate (PC), polypropylene (PP), polyethylene or the like, but not limitedly, as easily understood by those having ordinary skill in the art. In addition, the carrier 118 preferably has a thickness ranging from about 1.0 millimeter to about 20.0 millimeters. In particular, in case the carrier 118 is made of stainless steel, the carrier 118 has a thickness ranging from about 1.0 millimeter to about 2.0 millimeters. Also, in case the carrier 118 ms made of polycarbonate, the carrier 118 has a thickness of about 4.0 millimeter to about 10.0 millimeter.

The adhesion sheet 212 is used for preventing movement of the carrier 118 with respect to the support 116 and giving a cushion thereto to some extend while a glass G is polished using the upper unit 120 of the glass polishing system, in case the carrier 118 is placed on the support 116. For this purpose, the adhesion sheet 212 may adopt any material, size and structure well known in the art, as easily understood by those having ordinary skill in the art.

The mounting pad 214 is used for preventing the glass G from be damaged when the glass G is directly disposed on the supporting part 111 of the carrier 118. When the glass G is placed on the supporting part 111 of the carrier 118, the mounting pad 214 is interposed on the supporting part 111 in advance, and then the glass G is placed on the mounting pad 214. Also, the mounting pad 214 may adopt any material and/or structure well known in the art, as easily understood by those having ordinary skill in the art.

Hereinafter, a glass polishing method according to a preferred embodiment of the present invention is explained.

First, the carrier 118 supporting a glass G to be polished is placed on the support 116 installed to the turntable 112. Here, the glass G is preferably placed on the mounting pad 214 that is interposed on the surface of the supporting part 111 of the carrier 118. In addition, since the adhesion sheet 212 is already interposed on the support 116, vibrations applied to the glass G may be decreased through the carrier 118 when the carrier 118 is placed on the support 116. The carrier 118 may be placed on the support 116 in a manual manner or by means of a separate jig or the like. In this process, the protrusion 115 protruded on the rim of the carrier 118 surrounds an outer side of the support 116.

If the carrier 118 supporting the glass G is stably placed on the support 116 as mentioned above, the upper unit 120 is moved toward the glass G to contact the polishing pad 122 to the glass G.

Then, while a polishing slurry is supplied to the glass G through the upper unit 120, the upper unit 120 is moved and at the same time the turntable 112 of the lower unit 210 is rotated. Then, the glass G is polished by means of the polishing slurry supplied while the glass G and the upper unit 120 make relative movements.

Finally, after the glass G is completely polished, the upper unit 120 returns to its initial location, and then the carrier 118 on which the polished glass G is loaded is separated from the support 116 and carried to a next process by means of a conveyor.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A lower unit for a glass polishing system, comprising:

a support installed to a rotatable turntable;

a carrier having a supporting part for supporting a glass to be polished, and a placing part formed in a surface opposite to the supporting part and fixed and placed to the support; and a mounting pad installed on the supporting part such that the glass to be polished is mounted thereon, wherein the placing part of the carrier further includes a protrusion protruded on a rim of the carrier to surround a side of the support.

2. The lower unit for a glass polishing system according to claim 1, further comprising:

an adhesion sheet interposed between the support and the carrier.

3. The lower unit for a glass polishing system according to claim 1, wherein the carrier is made of any one material selected from the group consisting of stainless steel, aluminum, polycarbonate (PC), polypropylene (PP) and polyethylene (PE).

4. The lower unit for a glass polishing system according to claim 1, wherein the carrier has a thickness ranging from about 1.0 millimeter to about 20.0 millimeters.

5. The lower unit for a glass polishing system according to claim 4, wherein, in case the carrier is made of stainless steel, the carrier has a thickness of about 1.0 millimeter to about 2.0 millimeters.

6. The lower unit for a glass polishing system according to claim 4, wherein, in case the carrier is made of polycarbonate, the carrier has a thickness of about 4.0 millimeters to about 10.0 millimeters.

7. The lower unit for a glass polishing system according to claim 1, wherein the support is made of any one material selected from the group consisting of stainless steel, aluminum, carbon steel, tin, granite, polymer concrete and high-strength concrete.

8. The lower unit for a glass polishing system according to claim 1, wherein the support has a thickness ranging from about 50 millimeters to about 500 millimeters.

9. A glass polishing method, comprising:

(a) placing a carrier having a glass to be polished thereon to a support installed to a turntable;

(b) contacting an upper unit having a polishing pad installed thereto to the glass;

(c) supplying a polishing slurry to the glass to be polished through the upper unit; and (d) moving the upper unit and the turntable with respect to each other, wherein, in the step (a), the glass to be polished is supported on a mounting pad in a state that the mounting pad is interposed on the carrier, and wherein, in the step (a), the support is inserted into a space formed between protrusions formed on a rim of the carrier and formed in a lower surface of the carrier to fix the carrier.

10. The glass polishing method according to claim 9, further comprising:

separating the carrier from the support, in case the glass is completely polished.

11. The glass polishing method according to claim 9, wherein, in the step (a), an adhesion sheet is interposed on the support to place the carrier thereto.

* * * * *